United States Patent [19]

Adams et al.

[11] 4,199,960

[45] Apr. 29, 1980

[54] ACCUMULATOR FOR AIR CONDITIONING SYSTEMS

[75] Inventors: Cecil L. Adams, Mayfield Heights.; Norman E. Warner, Hudson, both of Ohio

[73] Assignee: Parker-Hannifin Corporation, Cleveland, Ohio

[21] Appl. No.: 955,048

[22] Filed: Oct. 26, 1978

[51] Int. Cl.[2] ..... F25B 43/00

[52] U.S. Cl. ..... 62/503; 55/463

[58] Field of Search ..... 62/503; 55/463

[56] References Cited

U.S. PATENT DOCUMENTS

| | | | |
|---|---|---|---|
| 3,488,678 | 1/1970 | Wagner | 62/503 |
| 3,837,177 | 9/1974 | Rockwell et al. | 62/503 |
| 4,111,005 | 9/1978 | Livesay | 62/503 |

*Primary Examiner*—Ronald C. Capossela
*Attorney, Agent, or Firm*—James A. Baker

[57] ABSTRACT

An accumulator for receiving a mixture of gaseous and liquid refrigerant fluid and liquid oil from an evaporator in an air conditioning system and for delivering only gaseous refrigerant fluid with oil atomized therein to the compressor. The accumulator has radially spaced telescoped straight lengths of tube to conduct the gaseous refrigerant fluid with oil atomized therein from the interior of the accumulator to the exterior thereof to thus eliminate the conventional U shaped tube for this purpose whereby the diameter of the accumulator may be smaller than the diameter needed to accommodate a U-shaped tube.

The inner one of the telescoped tubes conducts gaseous refrigerant fluid from the top of the accumulator to the bottom end of the outer telescoped tube where it picks up oil from the bottom of the accumulator through a bleed port through the wall of the outer tube and then passes unwardly between the tubes to an outlet port at the top of the accumulator.

20 Claims, 2 Drawing Figures

ACCUMULATOR FOR AIR CONDITIONING SYSTEMS

BACKGROUND OF THE INVENTION

Automotive air conditioning and other refrigerating systems commonly employ an accumulator between the outlet of the evaporator and the inlet of the compressor to receive a mixture of gaseous and liquid refrigerant fluid and liquid oil from the evaporator and deliver gaseous refrigerant fluid, with a small amount of atomized oil therein, to the compressor. The accumulator traps the remainder of the liquid oil and liquid refrigerant fluid to prevent slugs of liquid being drawn into the compressor, which would cause damage thereto.

A common form of accumulator, as shown in U.S. Pat. No. 3,488,678 has a U shaped tube therein with one leg of the U having an inlet opening at the upper part of the accumulator, the bottom of the U at the lower part of the accumulator, and the other leg of the U extending through the wall of the accumulator near the upper end thereof. The bottom portion of the U has a bleed port therein to permit oil in the bottom portion of the accumulator to enter the U shaped tube and to become dispersed in atomized form in the refrigerant gas passing through the U shaped tube to the exterior of the accumulator.

In such accumulators, the U tube must be of relatively large full capacity, such as ¾ inch O.D. or larger. Such tubes cannot be bent to a very small radius to form the U and the accumulator container must be of a rather large diameter so as to accomodate the U bend. As for example, a U tube of ¾ inch O.D. must have a radius of about 1½ inches to prevent wrinkling or flattening and therefore the container must be about 5 inches outside diameter or larger, in order to contain the U tube. This makes the container bulkier than it otherwise need be.

U.S. Pat. No. 3,837,177 discloses an accumulator in which telescoped straight tubes replace a U tube but the construction does not lend itself to use of inlet and outlet parts through the side wall of the container, as is required in many installations, nor are the telescoped tubes supported radially at both ends for better support thereof.

SUMMARY OF THE INVENTION

According to the present invention an accumulator is provided in which telescoped sections of straight tubes take the place of a U tube whereby the container may be of smaller diameter than when a U tube is employed. The telescoped tubes are radially spaced to form an annular clearance therebetween and extend from the upper to the lower part of the accumulator container. The clearance is closed at or near the upper end of the outer tube and the latter is closed at its lower end. The inner tube is open at its upper end to the interior of the container and is open at its lower end to the clearance between the tubes.

An inlet port at the upper end of the container connects to the interior of the container so that when a gas-liquid mixture enters the container through the inlet port the liquid falls to the bottom of the container and the gas enters the inner tube through the upper open end of the latter. An outlet port member at the upper end of the container connects the clearance between the tubes to the exterior of the container. Both the inlet and outlet ports extend through the side wall of the container for easier installation. Also, both the inner and outer tubes are rigidly supported against radial displacement at both their ends for adequate support therof. A bleed port through the lower end of the outer tube permits a small amount of oil to enter a passage between the lower end of the inner tube and the clearance between the tubes to be atomized and dispersed into the refrigerant gas flowing through the tubes.

The telescoped tubular structure provides the necessary flow path for gaseous refirgerant fluid from the top of the container to the lower portion of the container for picking up the oil without requiring a U bend in the tubular structure and thus permits the diameter of the container to be smaller than when a U bend is used. Thus, when the inner telescoped tube is of ¾ inch O.D. the outer tube can be about 1⅛ O.D. and the container can be of 3½ inch O.D., or less.

DETAILED DESCRIPTION

Figure 1:
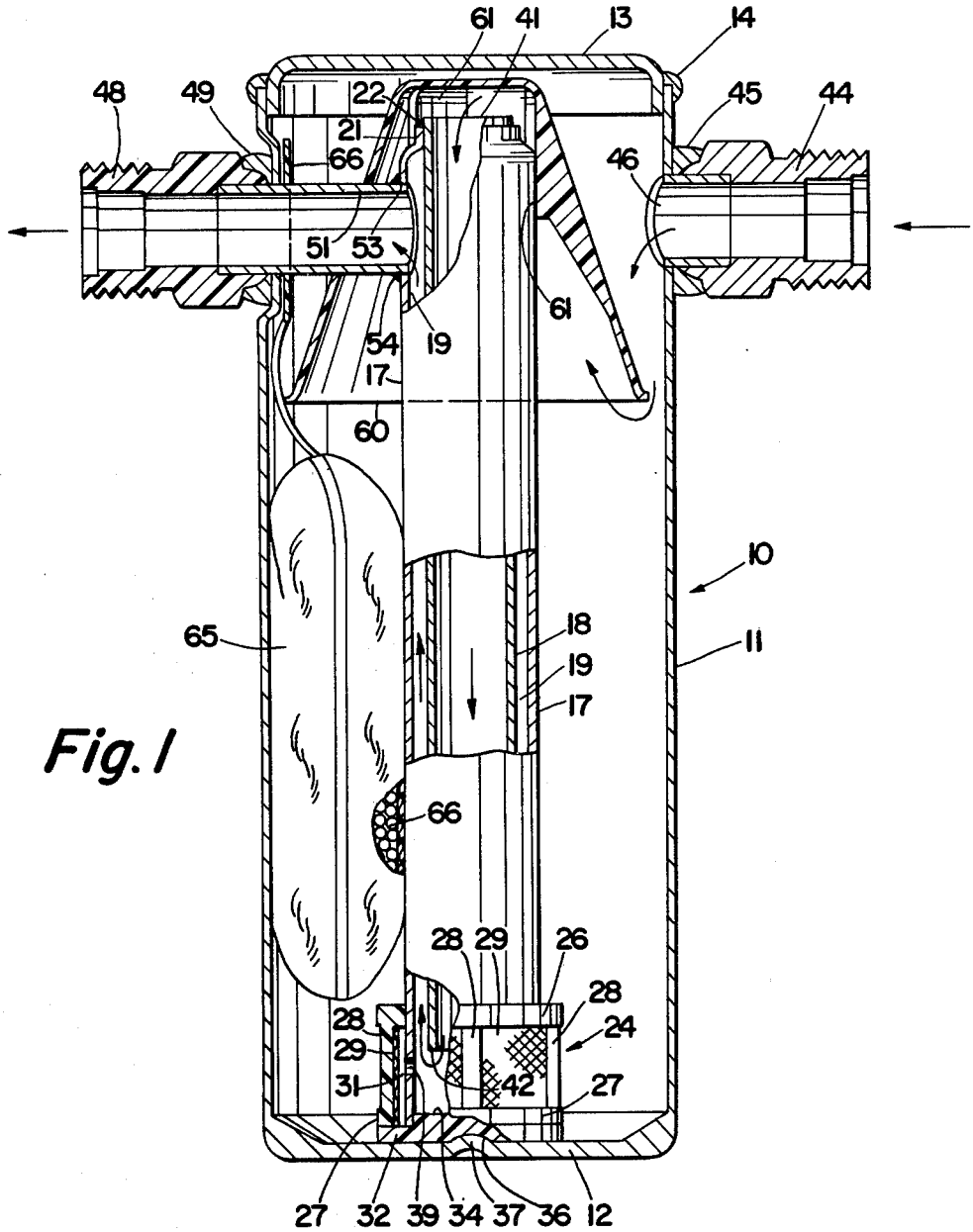
FIG. 1 is a view, partly in cross-section, of the accumulator.
Figure 2:
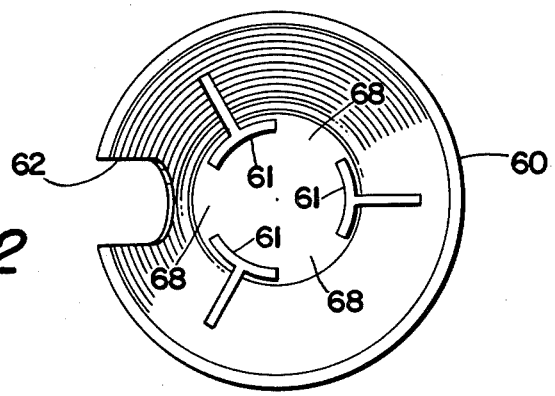
FIG. 2 is a bottom view of a shroud used in the accumulator.

The accumulator 10 includes a cylindrical container 11 having a closed bottom wall 12 and closed at its top by a cap 13 welded to the cylindrical portion of the container at 14.

Mounted within container 11 are a pair of telescoped tubes 17 and 18 that extend from the lower part of the container to the upper part. Outer tube 17 is radially spaced from inner tube 18 so as to provide an annular clearance 19 therebetween. At its upper end, outer tube 17 is neck down as at 21 and braised to inner tube 18 as at 22 to close the upper end of clearance 19. At its lower end, outer tube 17 is inserted into a cage 24 that comprises an upper ring 26 having a light press fit over the outer surface of tube 17 so as to be substantially sealed thereagainst. At its lower end cage 24 has another ring 27 whose inner diameter is radially spaced from the outer surface of tube 17 and is rigidly connected to ring 26 by means of several longitudinally spaced ribs 28. A cylindrical screen 29 is sealingly attached at its upper and lower ends to rings 26, 27 and is further supported by ribs 28. The screen 29 is also radially spaced as at 31 from tube 17.

A disk 32 overlies the lower end of ring 27 and is sealingly engaged therewith. Disc 32 has a central projection 34 that extends into tube 17 with a light press fit to close and seal the lower end of such tube. Disc 32 has a central curved recess 36 that receives a rounded projection 37 that is centrally of container bottom wall 12 to prevent lateral motion of tube 17 but which permits axial movement of the telescoped tube assembly towards final position against projection 37, as shown. In the final assembled position both tubes 17 and 18 are rigidly fixed against axial and radial movement at both their ends by welded connections at 22 and 54 and by projection 27 and disk 32. Between rings 26, 27, tube 17 has a bleed port 39 which permits liquid oil at the bottom of container 11 that has passed through screen 29 to enter the lower portion of tube 17.

Inner tube 18 is open at its upper end 41 and also at its lower end 42, such end 42 being spaced from disk projection 34 and preferably being above bleed port 39.

At the upper end of container 11 an inlet fitting 44 which is adapted to be connected to the outlet of the evaporator in an air conditioning or refrigeration system is welded to the container as at 45 and has an inlet port 46 communicating with the upper interior portion of container 11.

An outlet fitting 48 is adapted to be connected to the inlet of the compressor of the system and is likewise welded to the upper end of container 11 as at 49. Brazed to fitting 48 is a tubular insert 51 that extends into container 11 and has its inner end communicating with annular clearance 19 and which is brazed within an opening 53 in tube 17 so as to close such opening 53.

A shroud 60 of inverted cup shape has several longitudinally extending cylindrical segments 61 that have a press fit over outer tube 17 to hold the shroud in place as shown. The shroud also has a slot 62 to receive tubular member 51. A bag 65 of porous cloth contains desiccant material 66 and is suspended from tube 51 by a suitable tab 66. Because tube 51 is brazed as at 49 to container 11 and as at 54 to tube 17, tube 17 is rigidly held in a fixed position with container 11 so that it cannot move axially and also cannot move laterally at the upper end of container 11. Thus, tube 51 and projection 37 cooperate to completely fix the axial and lateral position of tube 17 and the parts attached thereto within container 11.

OPERATION

During operation of the air conditioning or refrigerating system, fluid from the evaporator, not shown, will enter fitting 44 and container 11. This fluid will comprise a mixture of gaseous and liquid refrigerant fluid and will also include some lubricating oil. Part of the oil will be in liquid form and part may be in atomized form. The liquid oil and liquid refrigerant fluid entering container 11 through port 46 will be prevented from being carried into the open upper end 41 of tube 18 by shroud 60 and will fall to the bottom of container 11. The liquid oil will settle at the bottom of the container and any liquid refrigerant fluid will be on top of the oil. Meanwhile, gaseous refrigerant fluid and any atomized oil that has entered the upper portion of container 11 will make its way downward to the lower part of shroud 60 and then be carried upward within the shroud and through the spaces 68 between cylindrical segments 61 and enter tube 18 through the latters open upper end 41. This gaseous and atomized material will then move downward in tube 18 and discharge through the lower end 42 of tube 15 into the lower end of tube 17 and then move upward through clearance 19 between the tubes and be discharged through port 51 and fitting 48 to the inlet of the system compressor. The liquid oil level within container 11 will normally be above bleed port 39 and will pass through screen 29 and annular space 31 through bleed port 39 into the interior of lower end of tube 17 and be atomized and carried upward in clearance 19 by the gaseous refrigerant fluid. The atomized oil is required for lubricating the moving parts of the compressor.

Any moisture within the closed refrigerant circuit will be absorbed by the desiccant particles 66.

The straight lengths of the telescoped tubes mounted and connected as shown permits the gaseous refrigerant fluid to enter the tubular structure at the upper portion of the container and pass to the lower portion of the container to pick up oil and then return to the upper portion of the container for discharge to the compressor without requiring a U bend in the tubing structure. This permits the diameter of container 11 to be considerably less than when a U shaped tube is mounted within a container to provide the flow path and function just described.

We claim:

1. An accumulator for an air conditioning system comprising a container having an inlet and an outlet at its upper end, a first hollow member extending between the upper and lower ends of the container, a second hollow member within the first member and radially spaced therefrom to define a radial clearance therebetween, first means closing said clearance at the upper end of said first member, second means closing the lower end of said first member, a flow passage connecting the lower end of the second member with said clearance, a bleed port connecting the interior of the container with the interior of said first member, said second member being open at its upper end to the interior of the container, said outlet being connected to said clearance and leading from said clearance to the exterior of the container.

2. The accumulator of claim 1 in which said second member terminates short of said second means to provide said flow passage therebetween.

3. The accumulator of claim 2 in which said bleed port is between the lower end of the second member and said second means.

4. The accumulator of claim 1 in which there is an annular screen that surrounds a portion of the lower end of said first member and is radially spaced therefrom, and there are means sealing upper and lower ends of the screen relative to said first member.

5. The accumulator of claim 4 in which said bleed port is positioned between said upper and lower sealing means.

6. The accumulator of claim 1 in which said second means includes a portion that has a press fit with a cylindrical wall of the first member.

7. The accumulator of claim 6 in which said portion of the second means is plug like and seals against the inside wall of said first member.

8. The accumulator of claim 1 in which said second means includes a transverse portion, and interlocking means on the transverse portion and a bottom wall of the container that transversely locates the lower end of the first member relative to the lower end of the container.

9. The accumulator of claim 1 in which the outlet includes a tubular member fixedly attached to a wall of the container and to an upper portion of the first member to rigidly locate the first member within the container.

10. The accumulator of claim 1 in which there is an inverted cup-like shroud over the upper ends of said members and axially and radially spaced therefrom to permit flow of gaseous refrigerant fluid upwardly into the shroud and downwardly into the open upper end of the second member.

11. The accumulator of claim 10 in which there is a vertical slot in the side wall of said shroud and said outlet includes a tubular member rigidly attached to said container and to said first member, said tubular member engaging portions of the edges of said slot to support the shroud in its position over the upper ends of said first and second members.

12. The accumulator of claim 4 in which said screen is attached to a cage comprising axially spaced upper and lower rings connected by a plurality of circumferentially spaced and axially extending bars and said screen is attached to said rings attached to upper and lower ends of screen.

13. The accumulator of claim 12 in which said second closing means is a disk having a portion press fitted into said lower ring.

14. The accumulator of claim 13 in which said disk includes an axial projection that extends into the lower end of said first member in sealing relation thereto.

15. The accumulator of claim 9 in which there is a bag of desiccant material suspended from said tubular member.

16. An accumulator for an air conditioning system comprising a tubular container having closed upper and lower ends, a first tube fixedly supported centrally of the container and extending between said upper and lower ends, a second tube within the first tube and radially spaced therefrom to form an annular clearance therebetween, means at the upper end of the first tube closing said clearance and supporting the upper end of the second tube against radial and axial movement relative to the first tube, the upper end of the second tube being open to the upper interior portion of the container, means closing the lower end of the first tube and the lower end of the second tube being open to said clearance, a bleed port connecting the lower portion of the container with the interior of said first tube, an inlet port through the wall of the container, and an outlet means extending through the wall of the container and connected to said clearance.

17. The accumulator of claim 16 in which there is a means at each end of the first tube to fix the transverse position of the first tube relative to said container.

18. The accumulator of claim 17 in which the fixing means at the lower end of the first tube comprises a member telescoped within the first tube and having an interlocking connection with the lower end of the container that prevents transverse movement of the lower end of the first tube relative to the container but which will permit axial movement of the first tube relative to the container during assembly of the first tube into the container.

19. The accumulator of claim 17 in which the fixing means at the lower end of the first tube includes axially overlapping recess and projection means on the container and closure means for the lower end of the first tube.

20. The accumulator of claim 16 in which the wall of the container through which the inlet port and outlet means extends is a side wall of the container.

* * * * *